US012708213B2

(12) United States Patent
Masunaga et al.

(10) Patent No.: US 12,708,213 B2
(45) Date of Patent: Aug. 18, 2026

(54) CHAIR

(71) Applicant: OKAMURA CORPORATION, Yokohama (JP)

(72) Inventors: Hiroshi Masunaga, Yokohama (JP); Syunsuke Ishimaru, Yokohama (JP); Syouichi Izawa, Yokohama (JP); Shinpei Totsuka, Yokohama (JP)

(73) Assignee: OKAMURA CORPORATION, Yokohama (JP)

( * ) Notice: Subject to any disclaimer, the term of this patent is extended or adjusted under 35 U.S.C. 154(b) by 168 days.

(21) Appl. No.: 18/694,360

(22) PCT Filed: Mar. 7, 2022

(86) PCT No.: PCT/JP2022/009737
§ 371 (c)(1),
(2) Date: Mar. 21, 2024

(87) PCT Pub. No.: WO2023/047635
PCT Pub. Date: Mar. 30, 2023

(65) Prior Publication Data

US 2024/0389755 A1 Nov. 28, 2024

(30) Foreign Application Priority Data

Sep. 22, 2021 (JP) ..... 2021-154890

(51) Int. Cl.
*A47C 7/00* (2006.01)
*A47C 7/44* (2006.01)

(52) U.S. Cl.
CPC ..... *A47C 7/44* (2013.01); *A47C 7/004* (2013.01)

(58) Field of Classification Search
CPC ..... A47C 7/44; A47C 7/004; A47C 7/282; A47C 31/02; A47C 31/023; A47C 7/40
See application file for complete search history.

(56) References Cited

U.S. PATENT DOCUMENTS 2,745,468 A * 5/1956 Kramer ..... A47C 3/021 297/285
4,390,210 A * 6/1983 Wisniewski ..... A47C 7/40 403/372

(Continued)

FOREIGN PATENT DOCUMENTS

JP 2009112396 A 5/2009
JP 2013094284 A * 5/2013 ..... A47C 7/282

(Continued)

OTHER PUBLICATIONS

Translation JP 2015-77338, 2015.*
International Search Report for Application No. PCT/JP2022/009737, mailed Apr. 12, 2022. (3 pages) .

*Primary Examiner* — Robert Canfield
(74) *Attorney, Agent, or Firm* — NIXON PEABODY LLP; Jeffrey L. Costellia

(57) ABSTRACT

A chair includes a lower structure configured to be placed on a floor surface (F), a backrest support member supported by the lower structure body, and a backrest supported by the backrest support member. The backrest includes a backrest body fixed to the backrest support member and provided with an opening portion (S2) that opens downward, and a tensile material provided in the backrest body and having a lower end portion that is locked on the backrest body. The backrest body includes a plate-shaped backrest main body fixed to the backrest support member and provided with a load-supporting surface that supports a load of a seated person. The backrest support member is inserted into the opening portion of the backrest body and is disposed on a rear side of the backrest main body.

7 Claims, 9 Drawing Sheets

(56) References Cited

U.S. PATENT DOCUMENTS

| | | | | | |
|---|---|---|---|---|---|
| 5,281,002 | A * | 1/1994 | Dauphin | A47C 31/11 | 297/DIG. 6 |
| 7,775,593 | B2 * | 8/2010 | Hu | A47C 7/402 | 297/353 |
| 8,845,024 | B2 * | 9/2014 | Beyer | A47C 7/44 | 297/284.3 |
| 9,167,910 | B2 * | 10/2015 | Krupiczewicz | A47C 31/02 | |
| 9,648,955 | B2 * | 5/2017 | Su | A47C 7/40 | |
| 10,602,855 | B2 * | 3/2020 | Naitou | A47C 7/40 | |
| 2002/0190564 | A1 * | 12/2002 | Coffield | A47C 5/06 | 297/452.56 |
| 2017/0027328 | A1 * | 2/2017 | Su | A47C 7/40 | |
| 2017/0035204 | A1 * | 2/2017 | Su | A47C 1/03255 | |
| 2025/0000259 | A1 * | 1/2025 | Masunaga | A47C 1/024 | |
| 2025/0176720 | A1 * | 6/2025 | Masunaga | A47C 7/40 | |
| 2025/0228367 | A1 * | 7/2025 | Masunaga | A47C 1/03272 | |

FOREIGN PATENT DOCUMENTS

| | | | | | |
|---|---|---|---|---|---|
| JP | 2015077338 | A * | 4/2015 | A47C 7/40 | |
| JP | 2020048990 | A | 4/2020 | | |
| JP | 2020062191 | A * | 4/2020 | | |
| JP | 2023046146 | A * | 4/2023 | A47C 31/023 | |
| WO | WO-2023047635 | A1 * | 3/2023 | A47C 31/023 | |

* cited by examiner

CHAIR

TECHNICAL FIELD

The present invention relates to a chair.

Priority is claimed on Japanese Patent Application No. 2021-154890, filed on Sep. 22, 2021, the content of which is incorporated herein by reference.

BACKGROUND ART

In the related art, as a chair used for office or the like, a chair is known that includes a lower structure such as a support base, a backrest support member such as a back rod supported by the lower structure, and a backrest supported by the backrest support member. For example, in the chair disclosed in Patent Document 1, the backrest includes a back frame formed in a frame shape and a tensile material provided in the back frame, and a lower portion of the back frame is fixed to the backrest support member.

DOCUMENT OF RELATED ART

Patent Document

[Patent Document 1] Japanese Unexamined Patent Application, First Publication No. 2009-112396

SUMMARY OF INVENTION

Problems to be Solved by Invention

However, in the chair disclosed in Patent Document 1, since the back frame of the backrest is formed in a frame shape, there is a problem that a portion of the backrest to be fixed to the backrest support member is limited.

Therefore, the present invention was made in view of the above circumstances, and provides a chair capable of increasing the degree of freedom of a portion of a backrest to be fixed to a backrest support member.

Means for Solving Problems

In order to achieve the above-described object, the present invention employs the following means.

That is, according to an aspect of the present invention, a chair includes a lower structure configured to be placed on a floor surface, a backrest support member supported by the lower structure, and a backrest supported by the backrest support member. The backrest includes a backrest body fixed to the backrest support member and provided with an opening portion that opens downward, and a tensile material provided in the backrest body and having a lower end portion that is locked on the backrest body. The backrest body includes a plate-shaped backrest main body fixed to the backrest support member and provided with a load-supporting surface that supports a load of a seated person. The backrest support member is inserted into the opening portion of the backrest body and is disposed on a rear side of the backrest main body.

In the chair configured in this manner according to the aspect, the backrest main body has a plate shape on which the load-supporting surface that supports the load of the seated person is formed. Since the backrest support member is inserted into the opening portion of the backrest body, it is possible to ensure a sufficient length of the backrest support member in an up-down direction without interference of the backrest support member with the backrest body. Thus, it is possible to fix an upper portion of the backrest main body to the backrest support member, and to increase a degree of freedom of a portion of the backrest to be fixed to the backrest support member.

Further, since the lower end portion of the tensile material is supported by the backrest body and provided in the backrest body, the backrest support member is hidden by the tensile material, and thus it is possible to suppress exposure of the backrest support member to the outside.

In addition, in the chair according to the aspect of the present invention, a width of the backrest main body may be greater than a width of the backrest support member.

In the chair configured in this manner, the backrest main body is firmly supported in the tensile material, the backrest support member is accommodated in the tensile material, and thus the appearance is made well. In addition, the deformation tolerance of both side portions of the backrest main body in the width direction is improved.

Further, in the chair according to the aspect of the present invention, the backrest body may include a rearward overhanging member provided with the opening portion and overhanging rearward from the backrest main body. The tensile material may include a front tensile material portion disposed in front of the backrest body, and a rear tensile material portion disposed behind the backrest body. The rearward overhanging member may include a front tensile material support portion disposed in front of the backrest support member and provided with a first locking portion on which the front tensile material portion is locked, and a rear tensile material support portion disposed in a side area of and behind the backrest support member and provided with a second locking portion on which the rear tensile material portion is locked.

In the chair configured in this manner, when the tensile material is provided in the backrest main body, the front tensile material portion is locked on the first locking portion of the front tensile material support portion, and the rear tensile material portion is locked on the second locking portion of the rear tensile material support portion. For example, if the tensile material is tacked to the backrest main body, the backrest support member is inserted into the opening portion of the rearward overhanging member. Thus, the backrest support member may hinder tacking work. In the above chair, since the work is work of locking the front tensile material portion to the first locking portion and locking the rear tensile material portion to the second locking portion, it is possible to perform the work without hindrance of the backrest support member.

Further, in the chair according to the above aspect of the present invention, the first locking portion may be recessed upward from a lower surface of the front tensile material support portion, and the second locking portion may be recessed upward from a lower surface of the rear tensile material support portion.

In the chair configured in this manner, the first locking portion has a shape that is recessed upward from the lower surface of the front tensile material support portion, and the second locking portion has a shape that is recessed upward from the lower surface of the rear tensile material support portion. Thus, when the rearward overhanging member is molded with resin, it is possible to cut out the opening portion, the first locking portion, and the second locking portion in the same direction, and it is possible to obtain favorable moldability.

Further, in the chair according to the aspect of the present invention, the rearward overhanging member may include an arch-shaped portion formed in an arch shape that protrudes rearward, and a tip end portion of a protrusion of the arch-shaped portion may be disposed to be spaced rearward from the backrest main body.

In the chair configured in this manner, the tip end portion of the protrusion of the arch-shaped portion of the rearward overhanging member is disposed to be spaced rearward from the backrest main body. Thus, when a rearward load is applied to the backrest main body, the backrest main body is not restrained by the arch-shaped portion of the rearward overhanging member, and it is possible to freely deform.

Effects of Invention

According to the chair according to the present invention, it is possible to increase the degree of freedom of a portion of a backrest to be fixed to a backrest support member.

EMBODIMENTS OF INVENTION

Hereinafter, a chair according to an embodiment of the present invention will be described with reference to FIGS. 1 to 9.

In the following description, for convenience of description, a direction in which a seated person sitting on a seat 17 (which will be described later) at a normal posture is directed forward will be referred to as "front", and a direction opposite thereto will be referred to as "rear". In addition, up-down and right-left directions in the following description mean directions that coincide with directions with the seated person as the center when the seated person sits on the seat 17 at the normal posture. Note that in some drawings, an arrow FR pointing forward, an arrow UP pointing upward, and an arrow LH pointing leftward are represented.

Figure 1:
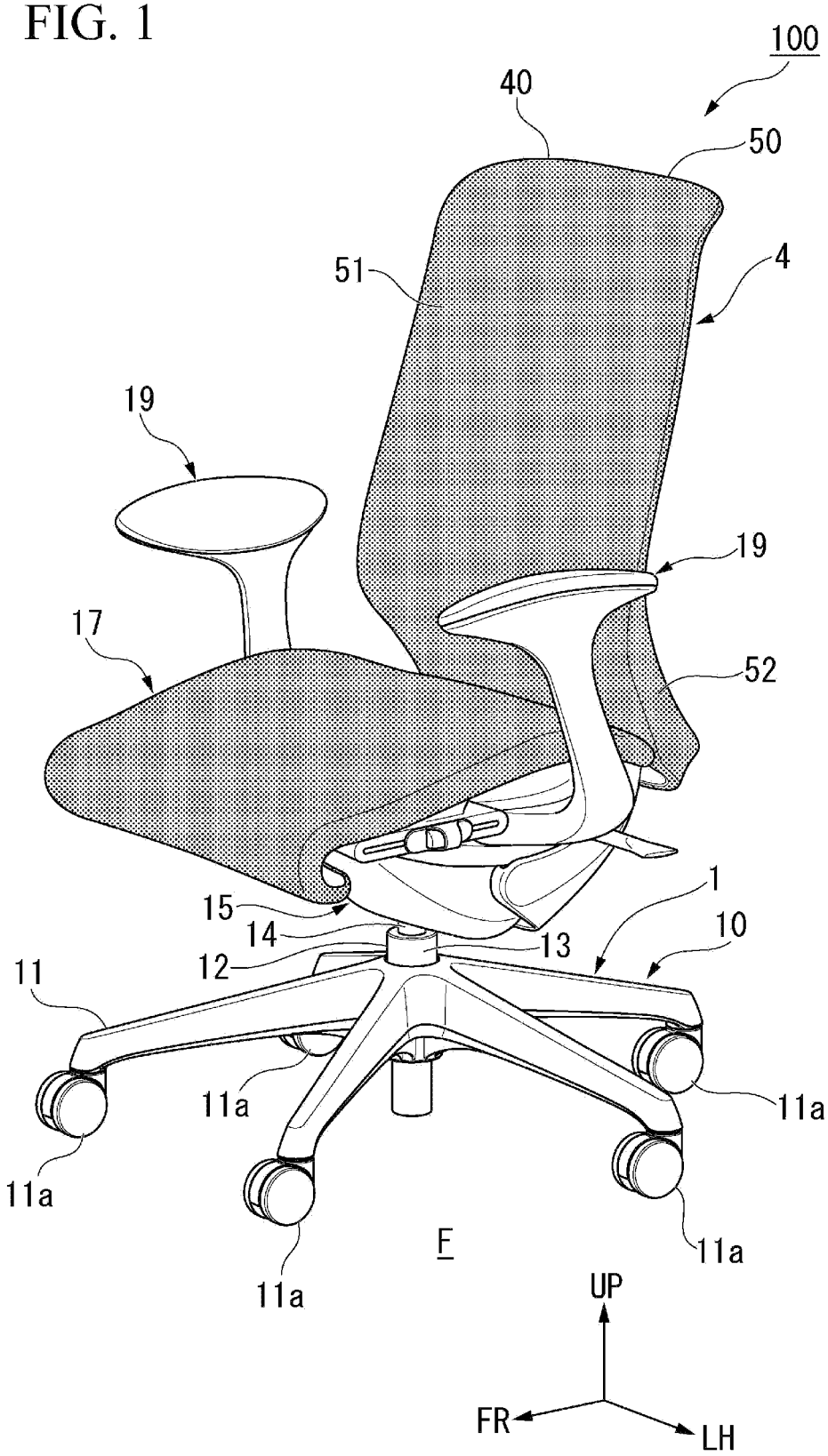
FIG. 1 is a perspective view of a chair according to an embodiment of the present invention when diagonally viewed from the front.

As represented in FIG. 1, a chair 100 according to the present embodiment includes a lower structure 1, a seat 17 attached to an upper portion of the lower structure 1, a backrest support member 22 (see FIG. 2) attached to a rear portion of the lower structure 1, a backrest 4 supported by the backrest support member 22, an armrest 19 that extends from both side portions of a lower portion side of the seat 17 to an upper side of the seat 17, and on which an elbow or an arm tip of a seated person are placed.

The lower structure 1 includes a leg portion 10 configured to be placed on a floor surface F and a support base 15 that has a box shape and is provided on an upper portion of the leg portion 10.

The leg portion 10 includes manifold legs 11 with a caster 11*a* and a pedestal 12 with a built-in gas spring (not represented) that stands up from a central portion of the manifold legs 11 and is a lifting mechanism. The pedestal 12 includes an outer cylinder 13 and an inner cylinder 14. The outer cylinder 13 is supported by being non-rotatably fitted to the manifold legs 11. A lower portion of the inner cylinder 14 is rotatably supported by the outer cylinder 13 in a horizontal direction. An upper portion of the inner cylinder 14 is fixed to the support base 15. A lifting adjustment mechanism of the pedestal 12 and a reclining mechanism of the backrest 4 are built in the support base 15.

Figure 3:
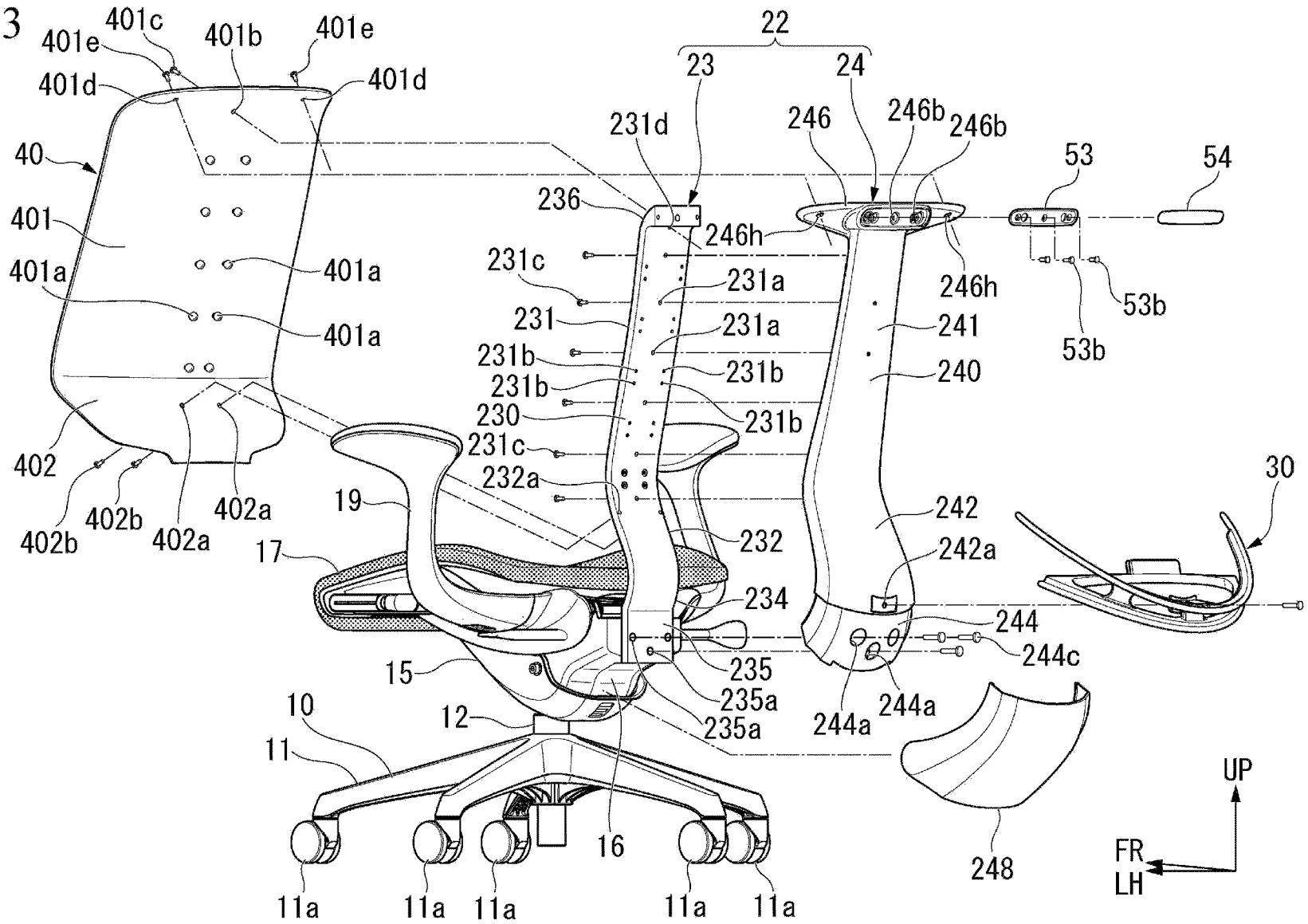
FIG. 3 is an exploded perspective view of the chair according to the embodiment of the present invention.

As represented in FIG. 3, the backrest support member 22 includes an inner member 23 and an outer member 24.

The inner member 23 has an elongated shape in the up-down direction. The inner member 23 is formed in a flat plate shape. A plate surface of the inner member 23 is directed substantially in a front-rear direction.

Figure 4:
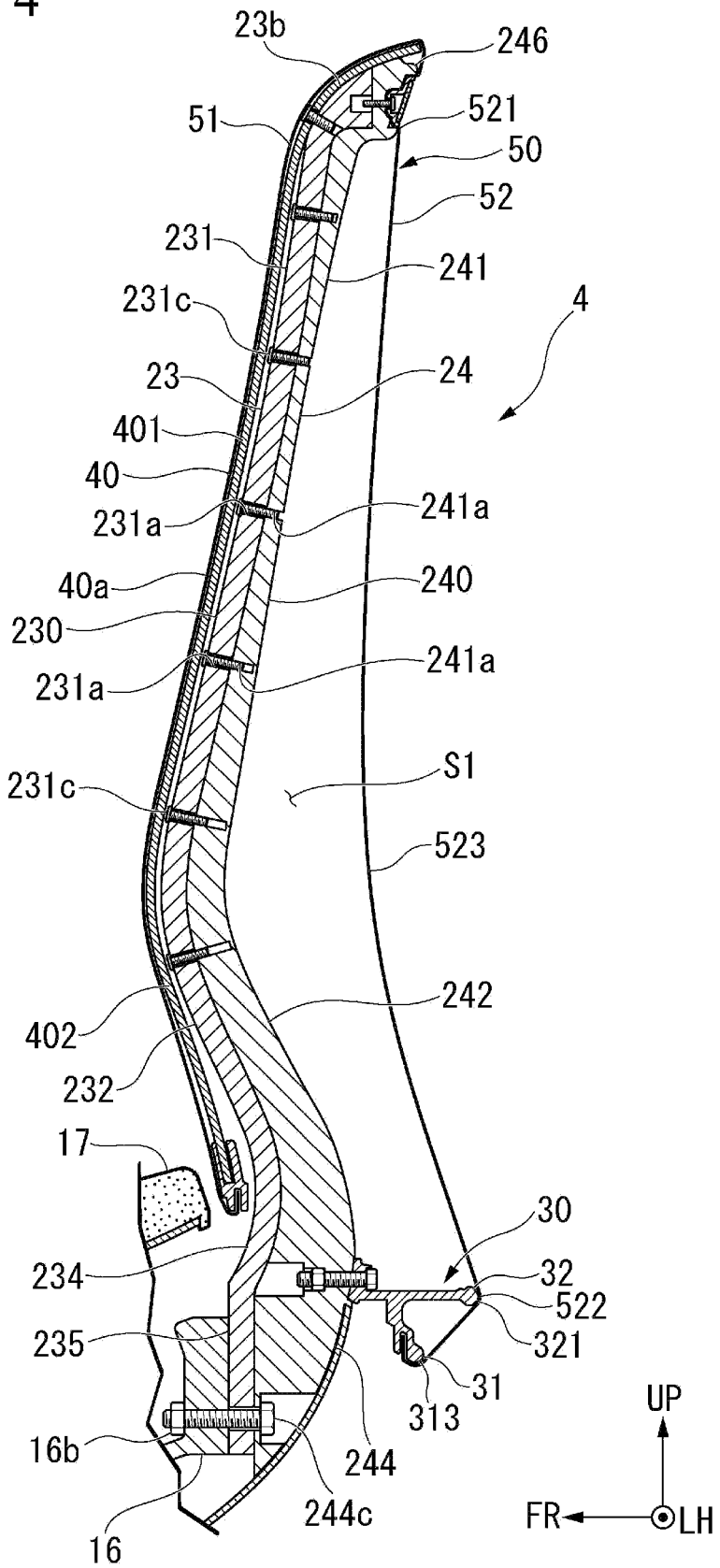
FIG. 4 is a longitudinal sectional view of the chair according to the embodiment of the present invention.

As represented in FIG. 4, the inner member 23 includes an inner up-down extension portion 230 and an inner upper overhanging portion 236. The inner up-down extension portion 230 includes an inner curved upper portion 231, an inner curved lower portion 232, an inner lower portion 234, and an inner lower fixing portion 235.

The inner curved upper portion 231 is inclined to be gradually directed rearward while being directed upward. As represented in FIG. 3, a plurality of attachment holes 231*a* penetrating in a plate thickness direction are formed to be spaced apart from each other in the up-down direction at the substantially center of the inner curved upper portion 231 in a width direction (right-left direction). A plurality of attachment holes 231*b* penetrating in the plate thickness direction are formed to be spaced apart from each other in the up-down direction on both end portion sides of the inner curved upper portion 231 in the width direction. An attachment hole 231*d* penetrating in the plate thickness direction is formed in an upper portion of the inner curved upper portion 231.

The inner curved lower portion 232 is inclined to be gradually directed rearward while being directed downward from a lower end portion of the inner curved upper portion 231. A portion where the lower end portion of the inner curved upper portion 231 and the upper end portion of the inner curved lower portion 232 are connected has a curved shape that protrudes forward. Attachment holes 232*a* penetrating in the plate thickness direction are formed on both end portion sides of the inner curved lower portion 232 in the width direction.

Figure 6:
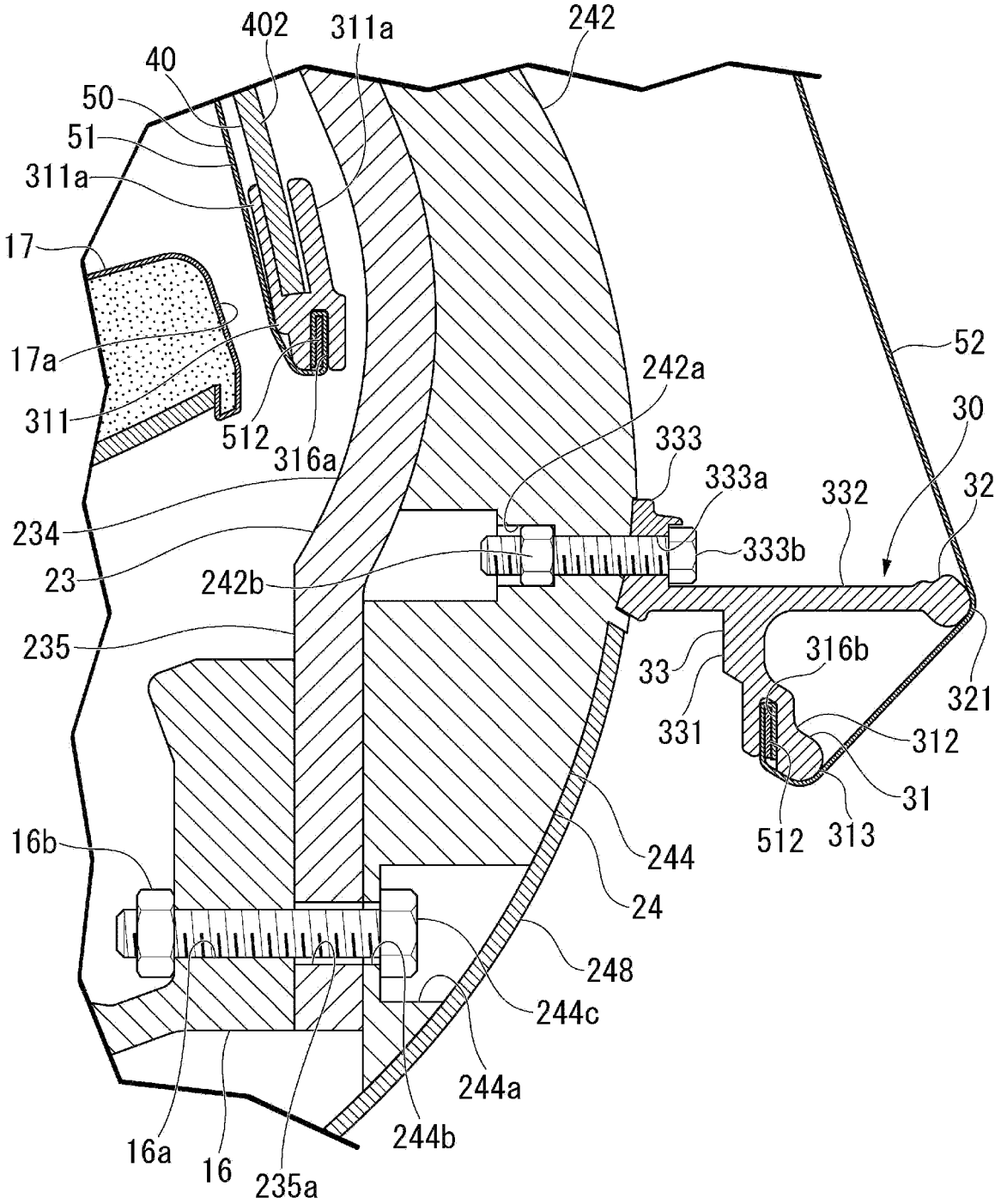
FIG. 6 is an enlarged view of a lower portion of FIG. 4.

The inner lower portion 234 is inclined to be gradually directed forward while being directed downward from the lower end portion of the inner curved lower portion 232. A portion where the lower end portion of the inner curved lower portion 232 and the upper end portion of the inner lower portion 234 are connected has a curved shape that protrudes rearward. As represented in FIG. 6, the portion where the lower end portion of the inner curved lower portion 232 and the upper end portion of the inner lower portion 234 are connected is curved to protrude rearward, whereby a rear end portion 17*a* of the seat 17 is positioned in the rear. As a result, it is possible to ensure the length of the seat 17 in the front-rear direction to be long.

The inner lower fixing portion 235 extends downward from a lower end portion of the inner lower portion 234. A plurality of attachment holes 235*a* penetrating in the plate thickness direction are formed in the inner lower fixing portion 235.

Figure 5:
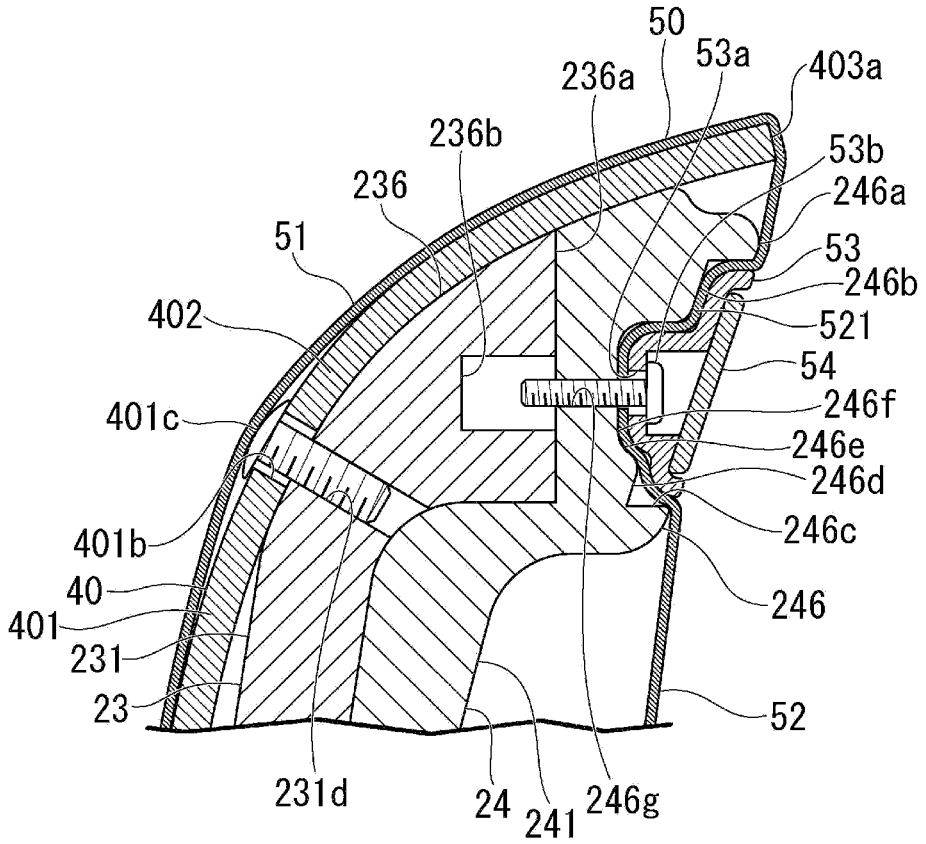
FIG. 5 is an enlarged view of an upper portion of FIG. 4.

As represented in FIG. 5, the inner upper overhanging portion 236 overhangs rearward from the upper end portion of the inner curved upper portion 231. An attachment recess portion 236*b* that is recessed forward is formed on a rear surface 236*a* of the inner upper overhanging portion 236, which is directed rearward.

As represented in FIG. 3, the outer member 24 covers substantially the entire rear surface of the inner member 23. The outer member 24 is wider than the inner member 23 and has an elongated shape in the up-down direction. The outer member 24 is formed in a flat plate shape. A plate surface of the outer member 24 is directed substantially in a front-rear direction.

The outer member 24 includes an outer up-down extension portion (up-down extension portion) 240 and an outer upper overhanging portion (upper overhanging portion) 246. The outer up-down extension portion 240 includes an outer curved upper portion 241, an outer curved lower portion 242, and an outer lower portion 244.

The outer curved upper portion 241 is inclined to be gradually directed rearward while being directed upward. The outer curved upper portion 241 is disposed on a rear side of the inner curved upper portion 231. As represented in FIG. 4, a plurality of attachment holes 241*a* that are recessed from the front surface to the rear surface are formed to be spaced apart from each other in the up-down direction, substantially at the center of the outer curved upper portion 241 in the width direction (right-left direction). A screw 231*c* is inserted into the attachment hole 231*a* of the inner curved upper portion 231 of the inner member 23 and is screwed into the attachment hole 241*a* of the outer curved upper portion 241 of the outer member 24. As a result, the inner member 23 and the outer member 24 are joined.

The outer curved lower portion 242 is inclined to be gradually directed rearward while being directed downward from a lower end portion of the outer curved upper portion 241. The outer curved lower portion 242 is disposed on a rear side of the inner curved lower portion 232. A portion where the lower end portion of the outer curved upper portion 241 and the upper end portion of the outer curved lower portion 242 are connected has a curved shape that protrudes forward. As represented in FIG. 3, an attachment hole 242*a* penetrating in the plate thickness direction is provided in the outer curved lower portion 242.

As represented in FIG. 6, the outer lower portion 244 is inclined to be gradually directed forward while being directed downward from the lower end portion of the outer curved lower portion 242. A portion where the lower end portion of the outer curved lower portion 242 and the upper end portion of the outer lower portion 244 are connected has a curved shape that protrudes rearward. A plurality of attachment recess portions 244*a* that are recessed forward are formed on a rear surface of the outer lower portion 244. An attachment hole 244*b* penetrating a front surface of the outer lower portion 244 is formed in a bottom portion (surface directed rearward) of the attachment recess portion 244*a*.

As represented in FIG. 3, a rear joining portion 16 is provided in a rear portion of the support base 15. The rear joining portion 16 is a portion of a rotating member that rotates around an axis of a main shaft (not represented) directed in the right-left direction with respect to the support base 15. As represented in FIG. 6, a bolt 244*c* is inserted into the attachment hole 244*b* from the attachment recess portion 244*a* of the outer lower portion 244 of the outer member 24, the attachment hole 235*a* of the inner lower fixing portion 235 of the inner member 23, and an attachment hole 16*a* formed in the rear joining portion 16. In this manner, a nut 16*b* is fastened to the bolt 244*c*. As a result, the inner member 23 and the outer member 24 are integrally fixed to the rear joining portion 16.

As represented in FIG. 3, the rear joining portion 16 and the outer lower portion 244 of the outer member 24 are covered with a rear cover 248 from the rear side.

The outer upper overhanging portion 246 overhangs rearward from an upper end portion of the outer curved upper portion 241. A width of the outer upper overhanging portion 246 is formed to be wider than a width of the outer curved upper portion 241. Attachment holes 246*h* penetrating in the plate thickness direction are formed on both sides of the outer upper overhanging portion 246 in the right-left direction.

As represented in FIG. 5, a plurality of recess portions 246*b* that are recessed forward are formed to be spaced apart from each other in the right-left direction on a rear surface 246*a* of the outer upper overhanging portion 246 that is directed rearward.

The recess portion 246*b* includes a first recess portion 246*c* that is recessed forward from the rear surface 246*a* of the outer upper overhanging portion 246 and a second recess portion 246*e* that is recessed forward from a bottom surface (surface that is directed rearward) 246*d* of the first recess portion 246*c*. An attachment hole 246*g* that penetrates to the front surface of the outer upper overhanging portion 246 is formed in a bottom surface (surface that is directed rearward) 246*f* of the second recess portion 246*e*.

Figure 2:
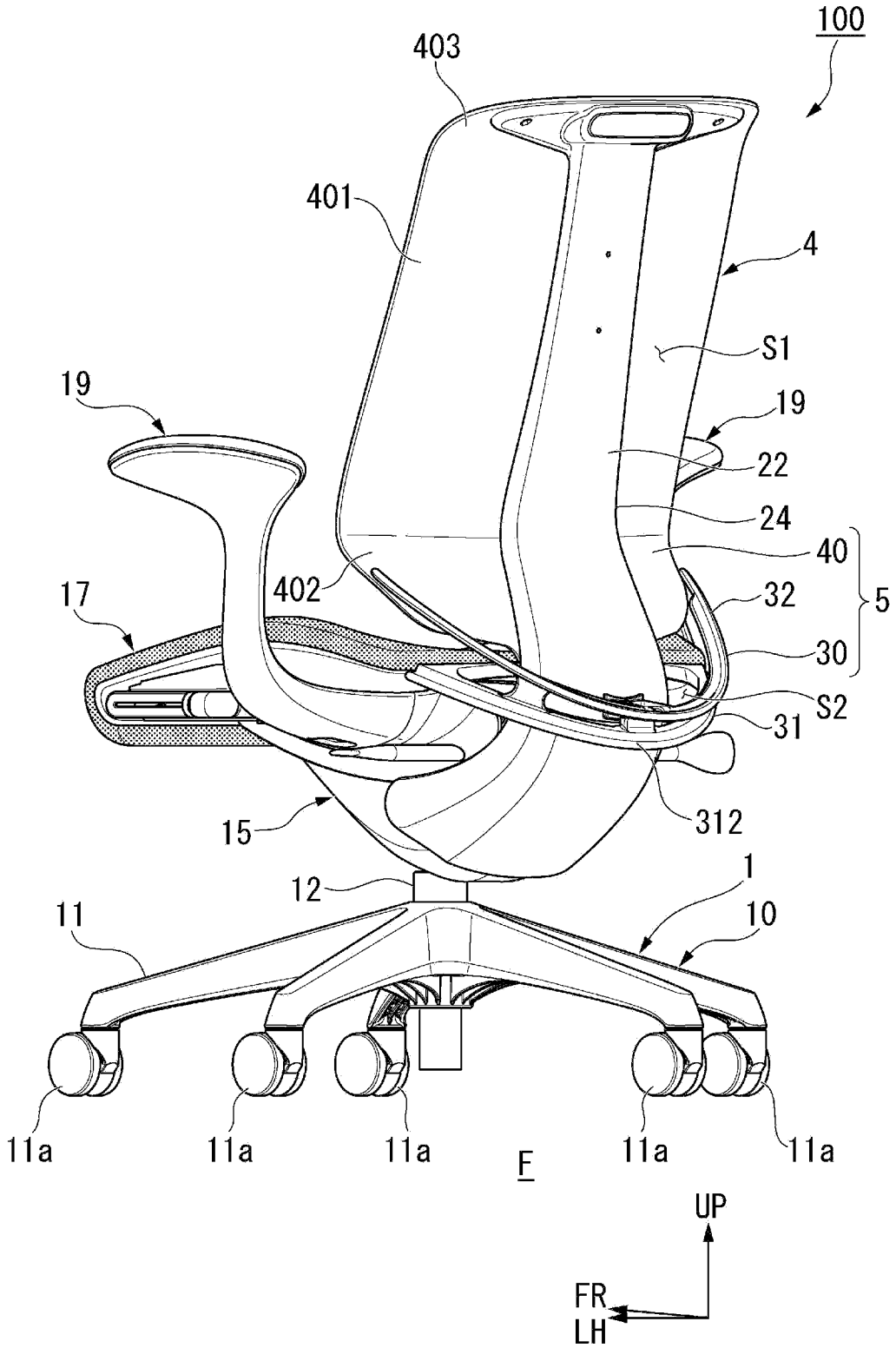
FIG. 2 is a perspective view of a state where a tensile material is removed from the chair according to the embodiment of the present invention, when diagonally viewed from the rear.

As represented in FIG. 2, the backrest 4 includes a backrest body 5 and a tensile material 50 (see FIG. 1). The backrest body 5 includes a backrest main body 40 and a rearward overhanging member 30.

The backrest main body 40 is fixed to the backrest support member 22. The backrest main body 40 is formed in a flat plate shape. A plate surface of the backrest main body 40 is directed substantially in the front-rear direction. The length of the backrest main body 40 in the width direction (direction LH) is greater than the length of the backrest support member 22 in the width direction (direction LH). The backrest main body 40 includes a back-plate curved upper portion 401, a back-plate curved lower portion 402, and an upper rearward overhanging portion 403.

As represented in FIG. 4, the back-plate curved upper portion 401 is inclined to be gradually directed rearward while being directed upward. The back-plate curved upper portion 401 is disposed on a front side of the inner curved upper portion 231. The upper rearward overhanging portion 403 is disposed on a front side of the inner upper overhanging portion 236 and on an upper side of the outer upper overhanging portion 246.

As represented in FIG. 3, a plurality of attachment holes 401*a* penetrating in the plate thickness direction are formed to be spaced apart from each other in the up-down direction and the right-left direction, substantially at the center of the back-plate curved upper portion 401 in the width direction (right-left direction). The attachment hole 401*a* and the attachment hole 231*b* of the inner member 23 are joined to each other by a fixing tool (not represented). Thus, an intermediate portion of the backrest main body 40 in the up-down direction is fixed to the inner member 23.

An attachment hole 401*b* penetrating in the plate thickness direction is formed at the center of an upper portion of the back-plate curved upper portion 401 in the width direction. As represented in FIG. 5, a screw 401*c* is inserted into the attachment hole 401*b* of the back-plate curved upper portion 401 and is screwed into the attachment hole 231*d* of the inner curved upper portion 231 of the inner member 23. Thus, an upper portion of the backrest main body 40 is fixed to the inner member 23.

Attachment holes 401*d* penetrating in the plate thickness direction are formed on both sides of an upper portion of the back-plate curved upper portion 401 in the right-left direction. A screw 401*e* is inserted into the attachment hole 401*d* and is screwed into the attachment hole 246*h* of the outer member 24. Thus, the upper portion of the backrest main body 40 is fixed to the outer member 24.

A portion above a portion of the backrest main body 40, which is fixed to the inner member 23 by the screw 401*c*, is an upper rearward overhanging portion 403. Then, a rear end portion 403*a* of the upper rearward overhanging portion 403 is located slightly behind the outer upper overhanging portion 246 in a side view in a direction LH, and is strongly in contact with an upper portion of a second tensile material portion 52 of the tensile material 50 which will be described later.

The back-plate curved lower portion 402 is inclined to be gradually directed rearward while being directed downward from a lower end portion of the back-plate curved upper portion 401. The back-plate curved lower portion 402 is disposed on the front side of the outer curved lower portion 242 of the outer member 24. A portion where the lower end portion of the back-plate curved upper portion 401 and the upper end portion of the back-plate curved lower portion 402 are connected has a curved shape that protrudes forward.

A plurality of attachment holes 402*a* penetrating in the plate thickness direction are formed in the back-plate curved lower portion 402 to be spaced apart from each other in the right-left direction. A screw 402*b* is inserted into the attachment hole 402*a* and is screwed into the attachment hole 232*a* of the inner member 23. Thus, the lower portion of the backrest main body 40 is fixed to the inner member 23.

As represented in FIG. 6, the lower end portion of the back-plate curved lower portion 402 is inserted from the top between two locking pieces 311*a* of a lower annular portion 31 of the rearward overhanging member 30, and is sandwiched between the two locking pieces 311*a*. As a result, the downward movement of the backrest main body 40 in the front-rear direction is restricted.

Front surfaces of the back-plate curved upper portion 401 and the back-plate curved lower portion 402 serve as a load-supporting surface 40*a* (see FIG. 4) that receives a load from the back of a seated person.

As represented in FIG. 2, the rearward overhanging member 30 is fixed to the lower portion of the outer member 24 and overhangs rearward from the outer member 24.

In other words, the rearward overhanging member 30 in the present embodiment is provided to overhang rearward from the lower portion of the backrest main body 40. Note that, the rearward overhanging member 30 may be provided to overhang rearward from a portion (for example, an intermediate portion in the up-down direction) of the backrest main body 40 other than the lower portion.

Figure 7:
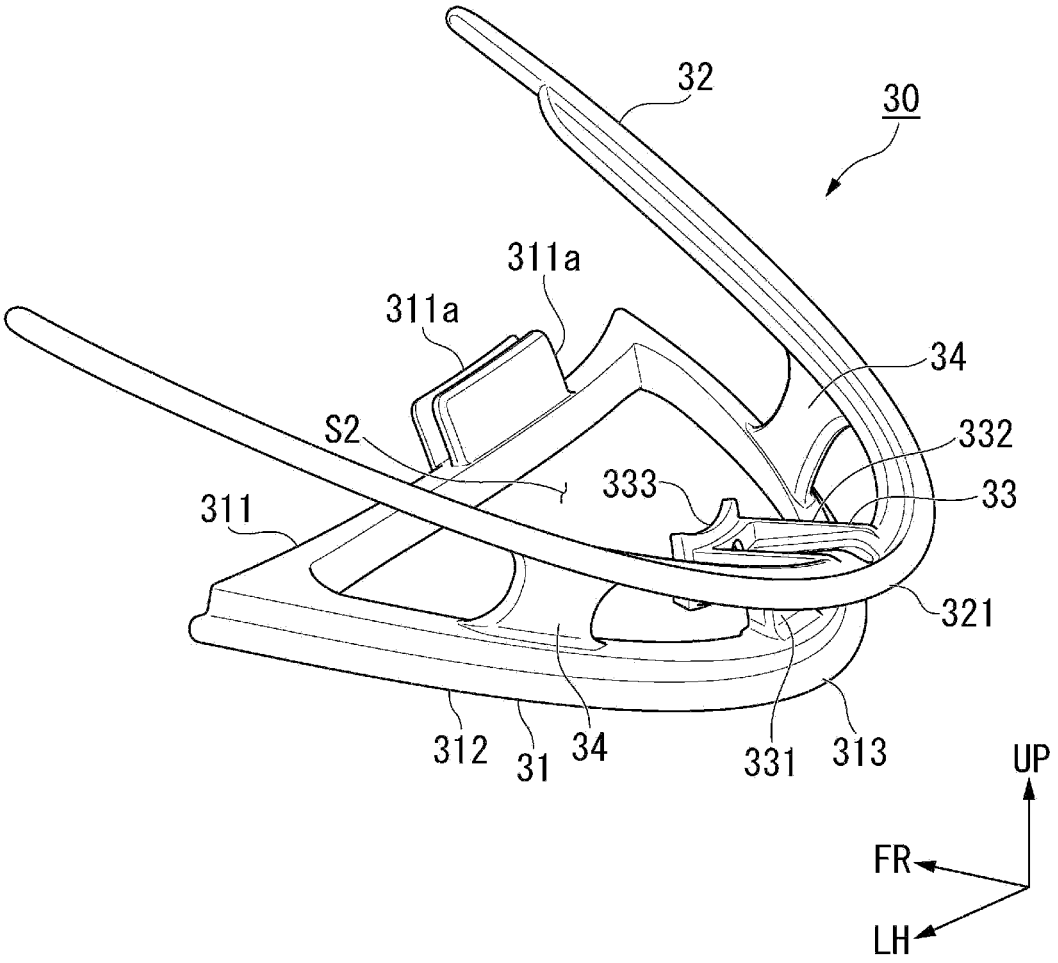
FIG. 7 is a perspective view of a rearward overhanging member of the chair according to the embodiment of the present invention, when diagonally from the rear and the top.
Figure 8:
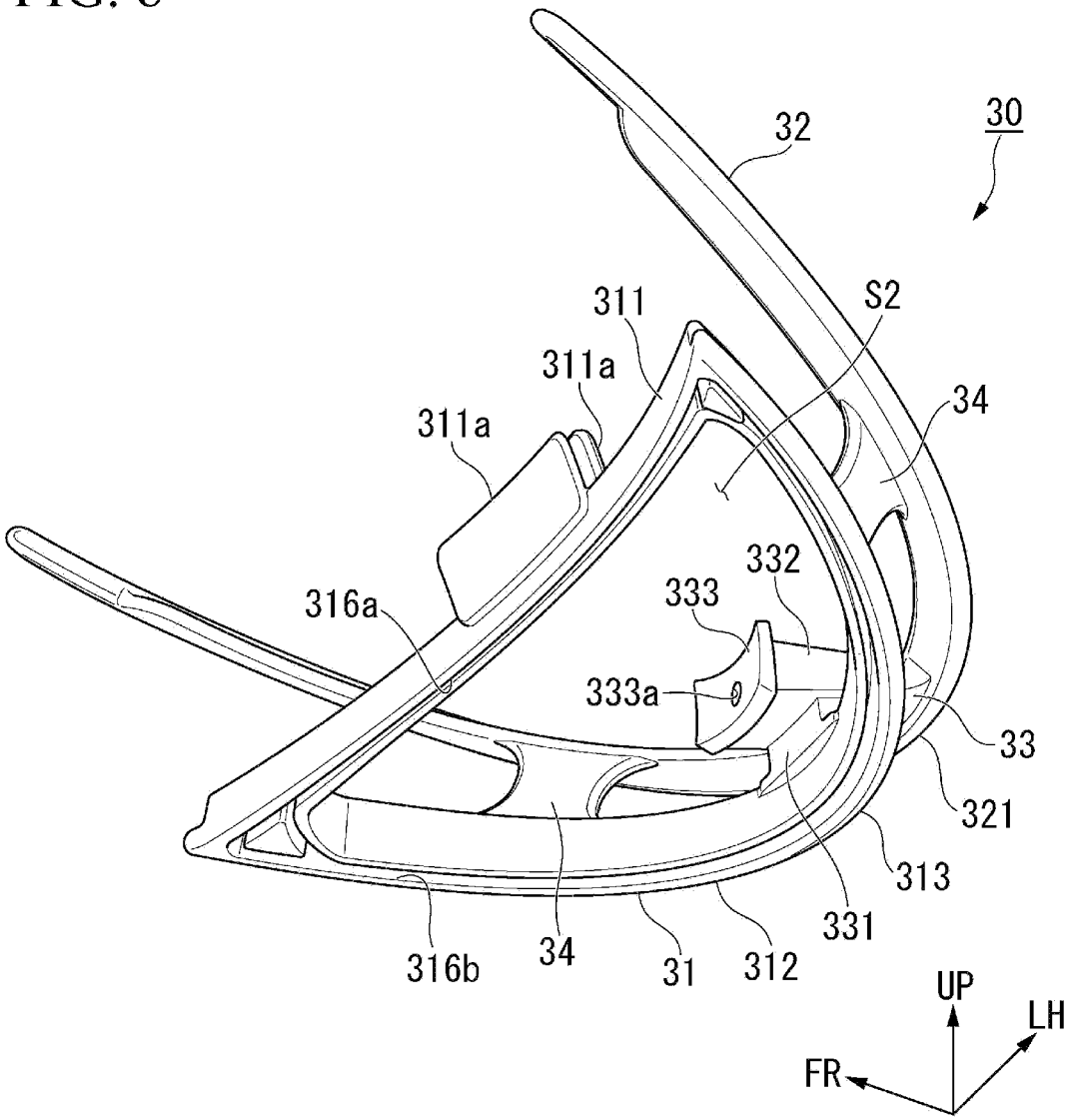
FIG. 8 is a perspective view of a rearward overhanging member of the chair according to the embodiment of the present invention, when diagonally from the front and the bottom.

As shown in FIGS. 7 and 8, the rearward overhanging member 30 includes a lower annular portion 31, an upper arch portion (arch-shaped portion) 32, a central joining portion 33, and two side joining portions 34.

The lower annular portion 31 is formed in an annular shape in a plan view. The lower annular portion 31 includes a front edge portion (front tensile material support portion) 311 and a curved portion (rear tensile material support portion) 312.

Figure 9:
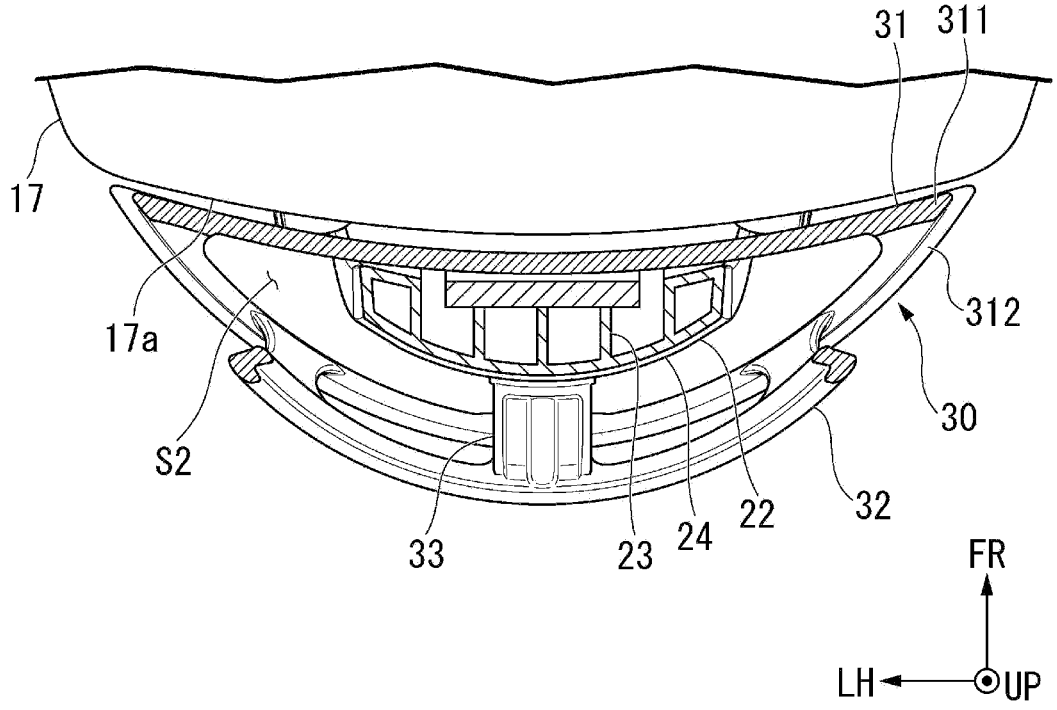
FIG. 9 is a horizontal sectional view including the rearward overhanging member of the chair according to the embodiment of the present invention.

As represented in FIG. 9, the front edge portion 311 has a curved shape in which the center in a width direction (right-left direction) slightly bulges rearward. The front edge portion 311 is disposed with a gap behind the rear end portion 17*a* of the seat 17. The front edge portion 311 is disposed with a gap in front of the backrest support member 22.

As represented in FIG. 7, two upward locking pieces 311*a* extending upward is provided in the center of the front edge portion 311 in the width direction. The two upward locking pieces 311*a* are disposed to be spaced apart from each other in the front-rear direction. The upward locking piece 311*a* is inclined to be directed upward while being directed forward.

The curved portion 312 has a semicircular arc shape in a plan view. The curved portion 312 has a shape that bulges rearward. The center of the curved portion 312 in the width direction serves as a first lower overhanging portion (lower overhanging portion) 313 that protrudes rearmost. Both end portions of the curved portion 312 in the right-left direction are each connected to both end portions of the front edge portion 311 in the right-left direction. As represented in FIG. 9, the curved portion 312 is disposed with a gap in the side area of and behind the backrest support member 22.

As represented in FIG. 8, a first locking groove (first locking portion) 316*a* that is recessed upward is formed on a lower surface of the front edge portion 311. The first locking groove 316*a* is formed along an extending direction of the front edge portion 311. A second locking groove (second locking portion) 316*b* that is recessed upward is formed on a lower surface of the curved portion 312. The second locking groove 316*b* is formed along an extending direction of the curved portion 312. The first locking groove 316*a* and the second locking groove 316*b* are continuously formed in an annular shape.

The upper arch portion 32 is disposed above the lower annular portion 31. The upper arch portion 32 is formed in a substantially semicircular arc shape in a plan view. The upper arch portion 32 is formed in an arch shape that protrudes rearward. The center of the upper arch portion 32 in the width direction serves as a second lower overhanging portion (lower overhanging portion) 321 that protrudes rearmost. As represented in FIG. 6, the second lower overhanging portion 321 is disposed above and behind the first lower overhanging portion 313. As represented in FIG. 2, an end portion of the upper arch portion 32 in the right-left direction is disposed in front of an end portion of the curved portion 312 in the right-left direction. As represented in FIG. 2, the end portions of the upper arch portion 32 in the right-left direction are disposed with a slight gap behind the back-plate curved lower portion 402.

As represented in FIG. 7, the central joining portion 33 joins the first lower overhanging portion 313 of the lower annular portion 31 and the second lower overhanging portion 321 of the upper arch portion 32. The central joining portion 33 includes an upper standing portion 331, a front extension portion 332, and a fixed piece portion 333.

The upper standing portion 331 extends upward from the first lower overhanging portion 313 of the lower annular portion 31. The front extension portion 332 extends forward from the second lower overhanging portion 321 of the upper arch portion 32. An upper end portion of the upper standing portion 331 is connected to the front extension portion 332. The fixed piece portion 333 is provided in a front end part of the front extension portion 332.

As represented in FIG. 6, an attachment hole 333*a* penetrating in the front-rear direction is formed in the fixed piece portion 333. A bolt 333*b* is inserted from the attachment hole 333*a* of the fixed piece portion 333 into the attachment hole 242*a* of the outer curved lower portion 242 of the outer member 24, and a nut 242*b* is fastened to the bolt 333*b*. As a result, the rearward overhanging member 30 is joined to the outer member 24.

As represented in FIG. 7, the side joining portions 34 join a portion of the lower annular portion 31 on a left side of the first lower overhanging portion 313 to a portion of the upper arch portion 32 on a left side of the second lower overhanging portion 321. As a result, a distance between the lower annular portion 31 and the upper arch portion 32 does not change.

The side joining portion 34 joins a portion of the lower annular portion 31 on the right side of the first lower overhanging portion 313 to a portion of the upper arch portion 32 on the right side of the second lower overhanging portion 321. As a result, the distance between the lower annular portion 31 and the upper arch portion 32 does not change.

As represented in FIG. 9, in the rearward overhanging member 30, an annular inside of the lower annular portion 31, a portion surrounded by the upper arch portion 32, and a portion inside the upper arch portion 32 serve as an opening portion S2 penetrating in the up-down direction. As represented in FIG. 2, the opening portion S2 communicates with a space S1 on the rear side of the backrest 4. The backrest support member 22 is inserted into the opening portion S2 and is disposed in the space S1. In other words, the opening portion S2 penetrates in the up-down direction, and causes a space that is above the rearward overhanging member 30 and between the backrest main body 40 and the second tensile material portion 52 to communicate with a space below the rearward overhanging member 30. The backrest support member 22 is inserted into the opening portion S2 and is disposed on the rear side of the backrest main body 40.

In the present embodiment, the backrest support member 22 is not in contact with an opening peripheral edge portion of the opening portion S2, that is, is not in contact with inner side surfaces of the lower annular portion 31 and the upper arch portion 32.

However, the backrest support member 22 may be configured to be in contact with at least a portion of the inner side surfaces of the lower annular portion 31 and the upper arch portion 32.

As described above, the rearward overhanging member 30 is configured as a separate member from the inner member 23, the outer member 24, and the backrest main body 40. As a result, it is possible to appropriately set a rearward overhanging amount of the first lower overhanging portion 313 and the second lower overhanging portion 321 regardless of the shapes of the inner member 23, the outer member 24, and the backrest main body 40.

As represented in FIG. 1, the tensile material 50 is provided (stretched) at the backrest body 5 (see FIG. 2) and covers the backrest body 5. The tensile material 50 is made of a cloth such as a mesh.

The tensile material 50 includes a first tensile material portion (front tensile material portion) 51 disposed on the front side and a second tensile material portion (rear tensile material portion) 52 disposed on the rear side. Both right and left end portions and upper end portions of the first tensile material portion 51 and the second tensile material portion 52 are continuous, and lower end portions thereof are open and have a bag shape.

As represented in FIG. 4, the first tensile material portion 51 is stretched along the front surface of the backrest main body 40. As represented in FIG. 6, an insertion member 512 is provided in the lower end portion of the first tensile material portion 51. The insertion member 512 and a lower end portion of the first tensile material portion 51, to which the insertion member 512 is attached, are inserted into and locked on the first locking groove 316*a* of the front edge portion 311 of the rearward overhanging member 30. As a result, the lower end portion of the first tensile material portion 51 is fixed to the rearward overhanging member 30.

As represented in FIG. 4, the second tensile material portion 52 is provided behind the outer member 24. As represented in FIG. 5, an upper portion 521 of the second tensile material portion (rear surface of the tensile material) 52 is disposed along the recess portion 246*b* of the outer member 24. A retaining member 53 is disposed on a rear side of the upper portion 521 of the second tensile material portion 52. The retaining member 53 has a shape that opens rearward. The upper portion 521 of the second tensile material portion 52 is sandwiched between the recess portion 246*b* of the outer member 24 and the retaining member 53 in the front-rear direction. An attachment hole 53*a* penetrating in the front-rear direction is formed in the retaining member 53. A screw 53*b* is inserted into the attachment hole 53*a* of the retaining member 53 and a through-hole formed in the second tensile material portion 52 and is screwed into the attachment hole 246*g* of the outer member 24. Thus, the upper portion 521 of the second tensile material portion 52 is fixed to the outer member 24. A cap 54 is fitted to a rear portion of the retaining member 53.

As represented in FIG. 4, a lower portion 522 of the second tensile material portion 52 is bent forward in a state of being in contact with (supported by) the second lower overhanging portion 321 of the rearward overhanging member 30, and is further bent forward in a state of being in contact with (supported by) the first lower overhanging portion 313.

A tensile-material rear surface portion 523 between the upper portion 521 and the lower portion 522 in the second tensile material portion 52 is disposed with the space S1 behind the outer up-down extension portion 240 of the outer member 24.

As represented in FIG. 6, the insertion member 512 is provided in the lower end portion of the second tensile material portion 52. The insertion member 512 and a lower end portion of the second tensile material portion 52, to which the insertion member 512 is attached, are inserted into and locked on the second locking groove 316*b* of the curved portion 312 of the rearward overhanging member 30. As a result, the lower end portion of the second tensile material portion 52 is fixed to the rearward overhanging member 30.

Since a space in the front-rear direction is formed between the locking groove 316 and the second lower overhanging portion 321, and the locking groove 316 is located below the second lower overhanging portion 321, no tension acts on the insertion member 512 to make the insertion member 512 come out vertically from the locking groove 316.

In the chair 100 configured in this manner, the backrest main body 40 has a plate shape on which the load-supporting surface 40*a* that supports the load of the seated person is formed. Since the backrest support member 22 is inserted into the opening portion S2 of the rearward overhanging member 30, it is possible to ensure the length of the backrest support member 22 in the up-down direction without interference of the backrest support member 22 with the rearward overhanging member 30. Thus, it is possible to fix the upper portion of the backrest main body 40 to the backrest support member 22, and to increase a degree of freedom of the portion of the backrest 4 to be fixed to the backrest support member 22.

Further, since the lower end portion of the tensile material 50 is supported by the rearward overhanging member 30 and is provided in the backrest main body 40, the backrest support member 22 is hidden by the tensile material 50, and thus it is possible to suppress the exposure of the backrest support member 22.

Further, since the backrest main body 40 is a flat plate-shaped member of which a plate surface is directed in the front-rear direction, it is possible to ensure the large load-supporting surface 40*a* and to improve the rigidity of the backrest main body 40.

In addition, the length of the backrest main body 40 in the width direction (direction LH) is greater than the length of the backrest support member 22 in the width direction (direction LH). Thus, the backrest main body 40 is firmly supported in the tensile material 50, the backrest support member 22 is accommodated in the tensile material 50, and thus the appearance is made well. In addition, the deformation tolerance of both side portions of the backrest main body 40 in the width direction is improved.

In addition, when the tensile material 50 is provided in the backrest main body 40, the first tensile material portion 51 is locked on the first locking groove 316*a* of the front edge portion 311 of the rearward overhanging member 30, and the second tensile material portion 52 is locked on the second locking groove 316*b* of the curved portion 312 of the rearward overhanging member 30. For example, if the tensile material 50 is tacked to the backrest main body 40, the backrest support member 22 is inserted into the opening portion S2 of the rearward overhanging member 30. Thus, the backrest support member 22 may hinder tacking work. In the above chair 100, since the work is work of locking the first tensile material portion 51 to the first locking groove 316*a* and locking the second tensile material portion 52 to the second locking groove 316*b*, it is possible to perform the work without hindrance of the backrest support member 22.

Further, the first locking groove 316*a* has a shape that is recessed upward from the lower surface of the first tensile material portion 51, and the second locking groove 316*b* has a shape that is recessed upward from the lower surface of the second tensile material portion 52. In other words, the first locking groove 316*a* has a shape that is recessed upward from the lower surface of the front edge portion 311, and the second locking groove 316*b* has a shape that is recessed upward from the lower surface of the curved portion 312. Thus, when the rearward overhanging member 30 is molded with resin, it is possible to cut out the opening portion S2, the first locking groove 316*a*, and the second locking groove 316*b* in the same direction, and the moldability is excellent.

Further, the tip end portion of the protrusion of the upper arch portion 32 of the rearward overhanging member 30 is disposed to be spaced rearward from the backrest main body 40. In other words, the intermediate portion between both ends of the upper arch portion 32 of the rearward overhanging member 30 is disposed to be spaced rearward from the backrest main body 40. Thus, when a rearward load is applied to the backrest main body 40, the backrest main body 40 is not restrained by the upper arch portion 32 of the rearward overhanging member 30, and it is possible to freely deform.

The chair 100 in the present embodiment includes the lower structure 1 configured to be placed on the floor surface F, the backrest support member 22 supported by the lower structure 1, and the backrest 4 supported by the backrest support member 22. The backrest 4 includes the backrest body 5 fixed to the backrest support member 22 and provided with the opening portion S2 that opens downward, and the tensile material 50 provided in the backrest body 5 and having the lower end portion that is locked on the backrest body 5. The backrest body 5 includes the backrest main body 40 having a plate shape, fixed to the backrest support member 22 and provided with the load-supporting surface 40*a* that supports a load of a seated person. The backrest support member 22 is inserted into the opening portion S2 of the backrest body 5 and is disposed on the rear side of the backrest main body 40.

The width of the backrest main body 40 in the width direction is greater than the width of the backrest support member 22 in the width direction.

The backrest body 5 includes the rearward overhanging member 30 provided with the opening portion S2 and overhanging rearward from the backrest main body 40. The tensile material 50 includes the first tensile material portion 51 disposed in front of the backrest body 5, and the second tensile material portion 52 disposed behind the backrest body 5. The rearward overhanging member 30 includes the front edge portion 311 disposed in front of the backrest support member 22 and provided with the first locking groove 316*a* on which the first tensile material portion 51 is locked, and the curved portion 312 disposed in the side area of and behind the backrest support member 22 and provided with the second locking groove 316*b* on which the second tensile material portion 52 is locked.

The first locking groove 316*a* is recessed upward from the lower surface of the front edge portion 311, and the second locking groove 316*b* is recessed upward from the lower surface of the curved portion 312.

The rearward overhanging member 30 includes the upper arch portion 32 formed in an arch shape that protrudes rearward, and the tip end portion of the protrusion of the upper arch portion 32 is disposed to be spaced apart from behind the backrest main body 40.

Note that, the technical scope of the present invention is not limited to the above embodiment and it is possible to make various changes thereto in a range not departing from the spirit of the present invention.

For example, in the embodiment described above, the backrest main body 40 is formed in a flat plate shape, but a slit or the like may be formed. In addition, the backrest main body may be configured by joining a plurality of flat plate-shaped members up, down, right, and left, or the members may be flat plate-shaped as a whole.

In addition, in the embodiment described above, the end portion of the upper arch portion 32 of the rearward overhanging member 30 in the right-left direction is disposed to be spaced rearward from the backrest main body 40. However, the present invention is not limited thereto. The end portion of the upper arch portion 32 of the rearward overhanging member 30 in the right-left direction may be in contact with or fixed to the backrest main body 40. When the end portion of the upper arch portion 32 of the rearward overhanging member 30 in the right-left direction is fixed to the backrest main body 40, the rigidity of the backrest body 5 is improved, and, when a load is applied to the backrest main body 40, the load can be integrally resisted.

In addition, in the embodiment described above, the backrest main body 40 and the rearward overhanging member 30 are configured to be separately provided and be joined to the backrest support member 22. However, the present invention is not limited thereto. The backrest main body 40 and the rearward overhanging member 30 may be integrally molded of a material such as resin.

In addition, in the embodiment described above, the first locking groove 316*a* and the second locking groove 316*b* have a shape that is recessed upward from the lower surface of the rearward overhanging member 30, but the present invention is not limited thereto. The shapes of the first locking portion and the second locking portion can be appropriately set, for example, the first locking groove 316*a* is formed to be recessed forward from the rear surface of the front edge portion 311, and the second locking groove 316*b* is formed to be recessed outward from the inner peripheral surface of the curved portion 312.

Further, in the embodiment described above, the rearward overhanging member 30 is joined to the outer member 24, but the present invention is not limited thereto. The rearward overhanging member 30 may be joined to the inner member 23, and the front edge portion 311 of the rearward overhanging member 30 and the back-plate curved lower portion 402 of the backrest main body 40 may be configured to be joined to the backrest support member 22. Further, the rearward overhanging member 30 may be fixed to the backrest main body 40. That is, it is sufficient that the rearward overhanging member 30 is supported by at least any one of the backrest support member 22 and the backrest main body 40.

Further, a configuration in which a cover member that closes the opening portion S2 of the rearward overhanging member 30 from below is mounted may be made.

In addition, it is possible to appropriately replace the constituent elements in the embodiments with well-known constituent elements in a range not departing from the spirit of the present invention, and such modifications may be combined as appropriate.

The invention claimed is:

1. A chair comprising:

a lower structure configured to be placed on a floor surface;

a backrest support member supported by the lower structure; and a backrest supported by the backrest support member, wherein the backrest includes a backrest body fixed to the backrest support member and provided with an opening portion that opens downward, and a tensile material provided on the backrest body and having a lower end portion that is locked on the backrest body, the backrest body includes a plate-shaped backrest main body fixed to the backrest support member and provided with a load-supporting surface that supports a load of a seated person, the backrest support member is inserted into the opening portion of the backrest body and is disposed on a rear side of the backrest main body, the backrest body includes a rearward overhanging member provided with the opening portion and overhanging rearward from the backrest main body, the tensile material includes a front tensile material portion disposed in front of the backrest body, and a rear tensile material portion disposed behind the backrest body, and the rearward overhanging member includes a front tensile material support portion disposed in front of the backrest support member and provided with a first locking portion on which the front tensile material portion is locked, and a rear tensile material support portion disposed in a side area of and behind the backrest support member and provided with a second locking portion on which the rear tensile material portion is locked.

2. The chair according to claim 1, wherein a width of the backrest main body is greater than a width of the backrest support member.

3. The chair according to claim 1, wherein the first locking portion is recessed upward from a lower surface of the front tensile material support portion, and the second locking portion is recessed upward from a lower surface of the rear tensile material support portion.

4. The chair according to claim 1, wherein the rearward overhanging member includes an arch-shaped portion formed in an arch shape that protrudes rearward, and a tip end portion of a protrusion of the arch-shaped portion is disposed to be spaced rearward from the backrest main body.

5. A chair comprising:

a lower structure configured to be placed on a floor surface;

a backrest support member supported by the lower structure; and a backrest supported by the backrest support member, wherein the backrest includes a backrest body fixed to the backrest support member and provided with an opening portion that opens downward, and a tensile material provided on the backrest body and having a lower end portion that is locked on the backrest body, the backrest body includes a plate-shaped backrest main body fixed to the backrest support member and provided with a load-supporting surface that supports a load of a seated person, and a rearward overhanging member provided with the opening portion and overhanging rearward from the backrest main body, and the backrest support member is inserted into the opening portion of the rearward overhanging member and is disposed on a rear side of the backrest main body.

6. The chair according to claim 5, wherein the backrest main body and the rearward overhanging member are integrally molded.

7. The chair according to claim 5, wherein the rearward overhanging member is fixed to the backrest main body.

* * * * *